US008026858B2

(12) United States Patent
Takaba et al.

(10) Patent No.: US 8,026,858 B2
(45) Date of Patent: Sep. 27, 2011

(54) GLASS ANTENNA DEVICE FOR A VEHICLE

(75) Inventors: Shinichi Takaba, Hitachi (JP); Hitoshi Horita, Hitachi (JP); Yuichi Anzai, Hitachi (JP); Masayoshi Kaneyasu, Itabashi-ku (JP)

(73) Assignee: Hitachi Cable, Ltd., Tokyo (JP)

( * ) Notice: Subject to any disclaimer, the term of this patent is extended or adjusted under 35 U.S.C. 154(b) by 265 days.

(21) Appl. No.: 11/968,486

(22) Filed: Jan. 2, 2008

(65) Prior Publication Data

US 2008/0246671 A1 Oct. 9, 2008

(30) Foreign Application Priority Data

Apr. 6, 2007 (JP) ..... 2007-100386

(51) Int. Cl.
*H01Q 1/32* (2006.01)

(52) U.S. Cl. ..... 343/713; 343/722; 343/712

(58) Field of Classification Search ..... 343/711, 343/712, 713

See application file for complete search history.

(56) References Cited

U.S. PATENT DOCUMENTS

| | | | | |
|---|---|---|---|---|
| 5,521,606 | A * | 5/1996 | Iijima et al. | 343/713 |
| 7,154,444 | B2 * | 12/2006 | Sievenpiper | 343/713 |
| 2004/0008146 | A1 | 1/2004 | Ikegaya et al. | |
| 2004/0066334 | A1 * | 4/2004 | Fang et al. | 343/700 MS |
| 2004/0196197 | A1 | 10/2004 | Sievenpiper | |
| 2008/0001824 | A1 * | 1/2008 | Castaneda et al. | 343/700 MS |

FOREIGN PATENT DOCUMENTS

| | | |
|---|---|---|
| EP | 1 343 221 A1 | 9/2003 |
| JP | 63-52307 | 4/1998 |
| JP | 2005-109811 | 4/2005 |
| JP | 2005-142984 | 6/2005 |
| JP | 2006-129226 | 5/2006 |
| JP | 2007-036446 | 2/2007 |
| WO | WO 2005/027260 A2 | 3/2005 |

OTHER PUBLICATIONS

Japanese Official Action dated Jan. 11, 2011 together with an English language translation.

* cited by examiner

*Primary Examiner* — Jacob Y Choi
*Assistant Examiner* — Kyana R McCain
(74) *Attorney, Agent, or Firm* — Scully, Scott, Murphy & Presser, P.C.

(57) ABSTRACT

An antenna element 1 is installed at a glass part 5 of a vehicle 4. The antennal element 1 has a ground part 3 and a radiating element 2. A metallic part side ground part 3*b* of the ground part 3 is overlapped with a metallic part 6 of the vehicle 4, while a glass part side ground part 3*a* of the ground part 3 and the radiating element 2 are not overlapped with the metallic part 6. The ground part 3 is installed such that a ratio of the area of the glass part side ground part 3*a* to be overlapped with the glass part 5 to the area of the metallic part side ground part 3*b* to be overlapped with the metallic part 6 is from 1:5 to 1:10.

14 Claims, 9 Drawing Sheets

GLASS ANTENNA DEVICE FOR A VEHICLE

The present application is based on Japanese Patent Application No. 2007-100386 filed on Apr. 6, 2007, the entire contents of which are incorporated herein by reference.

BACKGROUND OF THE INVENTION

1. Field of the Invention

The present invention relates to a glass antenna device for a vehicle, in more particular, to a glass antenna device for a vehicle having stable operating characteristics.

2. Related Art

A glass antenna device for a vehicle, in which an antenna element is installed on a window glass of a vehicle, has been conventionally known. For example, Japanese Patent Laid-Open No. 2005-109811 and Japanese Patent Laid-Open No. 2007-36446 disclose conventional glass antennas for a vehicle.

Further, in the glass antenna device for a vehicle in which the antenna element is installed on the window glass of the vehicle, it has been known to form the antenna element by conductor lines disposed in a lattice shape in order to improve invisibility and perceptibility of the antenna element on the window glass. For example, Japanese Patent Laid-Open No. 2005-142984 discloses such a kind of the glass antenna device for a vehicle.

The glass antenna device for a vehicle is mainly installed in a vicinity of a boundary between the window glass and a body frame, that is in general a corner of the window glass, since the glass antenna device for a vehicle is requested that a field of view of an operator or a crew will not be disturbed. On the other hand, the glass antenna device for a vehicle is demanded to have the stable operating characteristics without being affected by electrical influences due to outside members such as the body frame.

SUMMARY OF THE INVENTION

Therefore, it is an object of the present invention to provide a glass antenna device for a vehicle having stable operating characteristics.

According to a first feature of the invention, a glass antenna device for a vehicle, comprises:

an antenna element to be installed at a glass part comprising:

a ground part including a first part to be overlapped with a conductive member, and a second part not to be overlapped with a conductive member; and a radiating element not to be overlapped with a conductive member.

In the glass antenna device for a vehicle, the conductive member may be a metallic part of the vehicle.

In the glass antenna device for a vehicle, the conductive member may be a conductive tape overlapped with a metallic part of the vehicle.

In the glass antenna device for a vehicle, the antenna element may comprise linear conductors formed in a lattice shape.

In the glass antenna device for a vehicle, the first part of the ground part may comprise a plate-like conductor.

In the glass antenna device for a vehicle, the ground part may further comprise a marking part at a boundary of the first part and the second part.

In the glass antenna device for a vehicle, it is preferable that the ground part has a rectangular shape, and the radiating element comprises a first part extending vertically from one side of the ground part and a second part extending from the first part in parallel with the one side of the ground part.

In the glass antenna device for a vehicle, the radiating element may comprise two resonant parts having resonant frequencies different from each other.

In the glass antenna device for a vehicle, the conductive member may be a roof frame of the vehicle.

In the glass antenna device for a vehicle, the glass part may be a front glass of the vehicle.

In the glass antenna device for a vehicle, the antenna element may comprise a transparent sheet and a conductor printed on the transparent sheet.

In the glass antenna device for a vehicle, the antenna element may comprise a punched metal plate.

In the glass antenna device for a vehicle, it is preferable that the first part of the ground part is attached to the conductive member, and the second part of the ground part and the radiating element are attached to the glass part.

In the glass antenna device for a vehicle, the antenna element may comprise a glass member to be assembled as the glass part in the vehicle, and a conductor printed and annealed on the glass member.

In the glass antenna device for a vehicle, it is preferable that a ratio of an area of the second part to an area of the first part is within a range of 1:5 to 1:10.

According to a second feature of the invention, a vehicle provided with a glass antenna device comprises:

a glass part;

a metallic part; and an antenna element installed at a glass part, the antenna element comprising:

a ground part including a first part overlapped with the metallic part, and a second part not overlapped with the metallic part; and a radiating element not overlapped with the metallic part.

According to the present invention, following excellent effects can be obtained.

(1) It is possible to provide a glass antenna device for a vehicle having stable operating characteristics.

BRIEF DESCRIPTION OF THE DRAWINGS

Next, the present invention will be explained in more detail in conjunction with appended drawings, wherein.

DESCRIPTION OF THE PREFERRED EMBODIMENTS

Next, preferred embodiments according to the present invention will be explained in more detail in conjunction with the appended drawings.

First Preferred Embodiment

Figure 1:
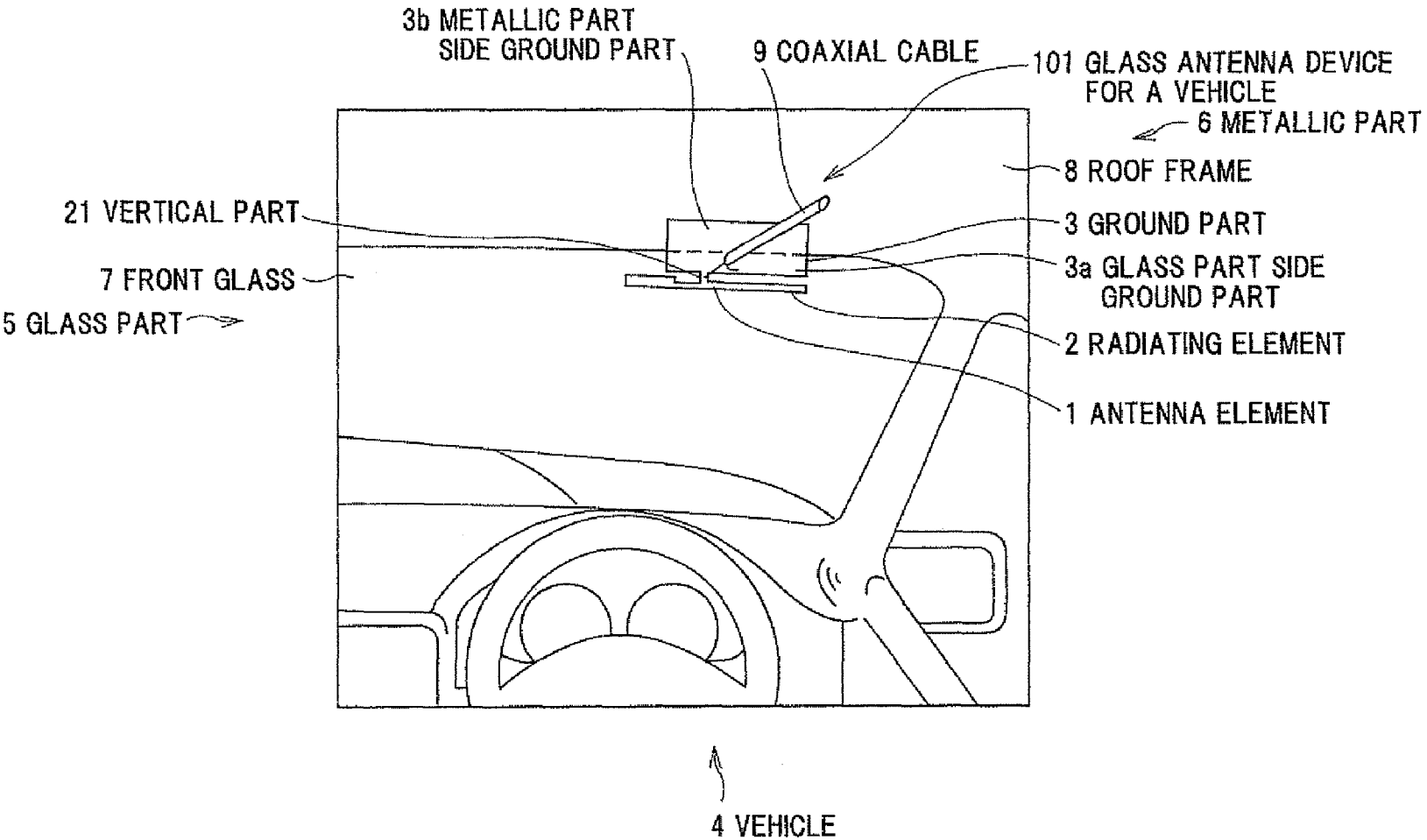
FIG. 1 is a schematic diagram of a glass antenna device for a vehicle that is installed in a vehicle in a first preferred embodiment according to the present invention.

FIG. 1 is a schematic diagram of a glass antenna device for a vehicle that is installed in a vehicle in a preferred embodiment according to the present invention.

As shown in FIG. 1, a glass antenna device 101 for a vehicle in the first preferred embodiment according to the invention comprises an antenna element 1 that is installed at a glass part 5 of a vehicle 4. The antennal element 1 comprises a ground part 3 and a radiating element 2. A part (metallic part side ground part) 3*b* of the ground part 3 is overlapped with a metallic part 6 of the vehicle 4, while another part (glass part side ground part) 3*a* of the ground part 3 and the radiating element 2 are not overlapped with the metallic part 6.

The ground part 3 comprises the glass part side ground part 3*a* to be overlapped with the glass part 5 of the vehicle 4, and the metallic part side ground part 3*b* to be overlapped with the metallic part 6 of the vehicle 4. The glass part side ground part 3*a* may be attached or securely fixed to the glass part 5 of the vehicle 4, and the metallic part side ground part 3*b* may be attached or securely fixed to the metallic part 6 of the vehicle 4. In other words, the glass part side ground part 3*a* is not overlapped with a conductive member, and the metallic part side ground part 3*b* is overlapped with the conductive member. An area of the ground part 3 is a total of an area of the glass part side ground part 3*a* to be overlapped with the glass part 5, and an area of the metallic part side ground part 3*b* to be overlapped with the metallic part 6.

Figure 2:
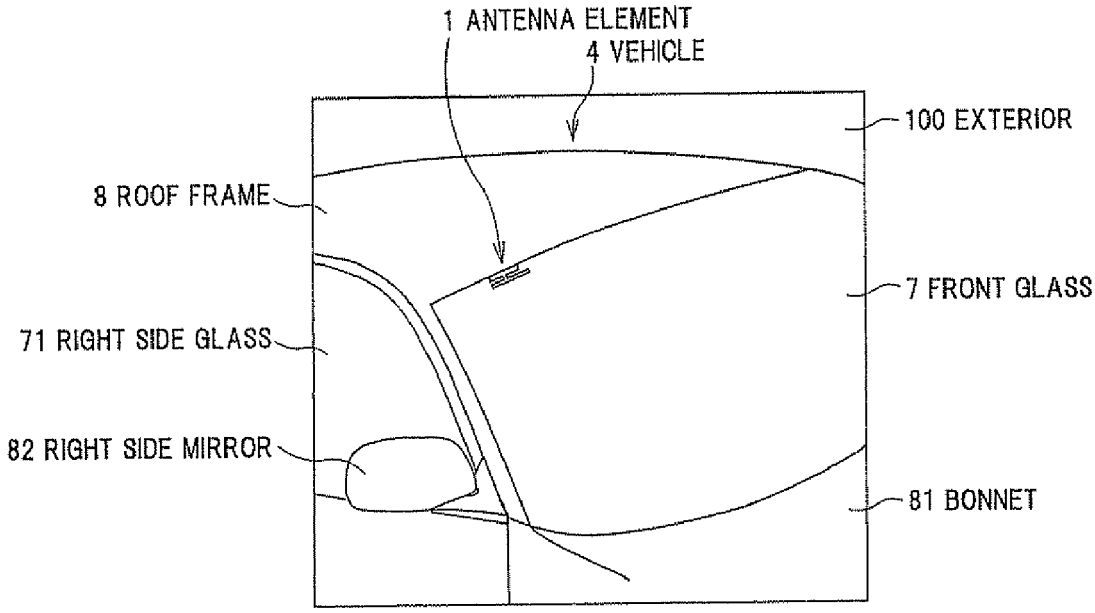
FIG. 2 is a partial perspective view of a vehicle in which the glass antenna device for a vehicle shown in FIG. 1 is installed.

FIG. 2 is a partial perspective view of a vehicle in which the glass antenna device for a vehicle shown in FIG. 1 is installed.

As shown in FIGS. 1 and 2, the antenna element 1 of the glass antenna device 101 for a vehicle is installed at a front glass 7 as the glass part 5, and disposed in a vicinity of a boundary between the front glass 7 as the glass part and a roof frame 8 as the metallic part 6. Since the front glass 7 is fitted into a glass supporting frame (not shown) that is a part of the roof frame 8, the front glass 7 is overlapped with the glass supporting frame that is the part of the roof frame 8 at a boundary between the front glass 7 and the roof frame 8. However, a location of the glass antenna device 101 for a vehicle is not limited thereto. The glass antenna device 101 for a vehicle may be located anywhere in the vicinity of the boundary with the metallic part 6 as long as the antenna element 1 is located at the glass part 5.

In the glass antenna device 101 for a vehicle comprising the antenna element 1 installed at the front glass 7, the metallic part side ground part 3*b* of the ground part 3 is overlapped with the glass supporting frame that is the part of the roof frame 8, while the glass part side ground part 3*a* of the ground part 3 and the radiating element 2 are not overlapped with the metallic part 6. Therefore, when the antenna element 1 is viewed from a side where the glass supporting frame is provided, the radiating element 2 and the glass part side ground part 3*a* of the ground part 3 appear on a glass surface, namely the radiating element 2 and the glass part side ground part 3*a* of the ground part 3 can be seen through the glass part 5, and the metallic part side ground part 3*b* of the ground part 3 is hidden behind the glass supporting frame.

FIG. 2 shows an example in that the antenna element 1 of the glass antenna device 101 for a vehicle is attached to a right front part of the front glass 7 of a passenger car. A right side glass 71, a bonnet 81, a right side mirror 82, and an exterior 100 of the vehicle 4 are illustrated for showing the location of the antenna element.

A power feeding from the outside (a power source installed inside of the vehicle 4, not shown) to the glass antenna device for a vehicle 101 shown in FIG. 1 is conducted through a coaxial cable 9 installed from the outside to the antenna element 1. An inner conductor which is a signal line of the coaxial cable 9 is directly soldered to a first part (vertical part) 21 of the antenna element 1, and an outer conductor which is a ground line of the coaxial cable 9 is directly soldered to the ground part 3. A soldering point appearing on a surface of the glass part 5 is protected by covering with a cover member (not shown).

Next, respective elements of the glass antenna device 101 for a vehicle will be explained in more detail.

(Antenna Element 1)

Figure 3A:
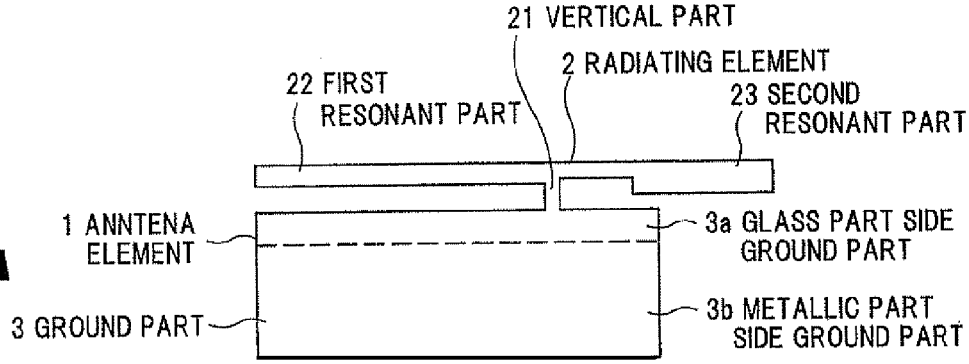
FIGS. 3A to 3D are plan views of antenna elements of a glass antenna device for a vehicle in the first to fourth preferred embodiments according to the present invention.

FIG. 3A is a plan view of the antenna element 1 of the glass antenna device 101 for a vehicle in the first preferred embodiment according to the invention.

The antenna element 1 comprises the radiating element 2 and the ground part 3 as shown in FIG. 3A. The ground part 3 is formed to have a narrow and lengthy rectangular shape. The radiating element 2 is formed to have one side that is parallel to one side of the ground part 3 and to have a rectangular shape narrower than the ground part 3. The radiating element 2 is provided to be distant from the one side of the ground part 3 by a predetermined spacing. The ground part 3 comprises a glass part side ground part 3*a* and a metallic part side ground part 3*b* as shown by a broken line.

The radiating element 2 is connected to the ground part 3 via the first part (vertical part) 21 that is extended vertically from the one side of the ground part 3, and comprises a second part extending from the vertical part 21 in parallel with the one side of the ground part 3. The second part of the radiating element 2 comprises a first resonant part 22 and a second resonant part 23 having resonance frequencies different from each other. The first resonant part 22 and the second resonant part 23 are provided at one side and another side of the radiating element 2 with respect to the vertical part 21. In other words, the radiating element 2 comprises the vertical part 21 extending vertically from the ground part 3, and the first and second resonant parts 22, 23 extending from the vertical part 21 in parallel with the ground part 3.

The first resonant part 22 has a predetermined width and a predetermined length, and extends to one end (left end in FIG. 3A) of the ground part 3. The first resonant part 22 is facing to the ground part 3 along its entire length.

The second resonant part 23 has a width and a length larger than those of the first resonant part 22, and extends over another end (right end in FIG. 3A) of the ground part 3. A part of the second resonant part 23 is facing to the ground part 3 and a remaining part of the second resonant part 23 extends over another end of the ground part 3.

The area of the ground part 3 is greater than the area of the radiating element 2.

The glass antenna device 101 for a vehicle may be used as a transmitting and receiving antenna for a portable telephone or the like.

(Function and Effect of the Glass Antenna Device 101 for a Vehicle)

Function and effect of the glass antenna device 101 for a vehicle in the present invention will be explained below.

According to the present invention, the ground part 3 of the antenna element 1 comprises the glass part side ground part 3*a* not to be overlapped with the metallic part 6 and the metallic part side ground part 3*b* to be overlapped with the metallic part 6. According to this structure, it is possible to obtain a large area of the ground part 3. Further, it is possible to obtain the stable operating characteristics, since the glass part side ground part 3*a* is not overlapped with the metallic part 6.

If an entire part of the ground part 3 is overlapped with the metallic part 6, it will be impossible to obtain desired antenna characteristics, since an electric field distribution between the radiating element 2 and a part of the ground part 3 facing to the radiating element 2 affects on antenna characteristics. In the present invention, the glass part side ground part 3*a* of the ground part 3 facing to the radiating element 2 is not overlapped with the metallic part 6, so that the desired antenna characteristics can be obtained.

In the antenna element 1 of the glass antenna device 101 for a vehicle shown in FIG. 3A, the ground part 3 has a narrow rectangular shape. The glass antenna device 101 for a vehicle is provided in a position that a long side of the antenna element 1 is provided in parallel with the boundary between the glass part 5 and the metallic part 6. The ground part 3 is installed such that a ratio of the area of the glass part side ground part 3*a* to be overlapped with the glass part 5 to the area of the metallic part side ground part 3*b* to be overlapped with the metallic part 6 is a predetermined value, namely, from 1:5 to 1:10. Since an appropriate and effective value of this ratio depends on a frequency to be used, a configuration of the antenna element 1 or the like, it is preferable to set this ratio appropriately in accordance with the difference of the frequency, the configuration of the antenna element 1 or the like.

Further, as described above, it is possible to provide the vehicle 4 provided with the glass antenna device 101, in which the antenna element 1 is installed at the glass part 5 such as the front glass 7, and the antenna element 1 comprises the ground part 3 including the metallic part side ground part 3*b* that is overlapped with the metallic part 6 such as the roof frame 8, and the glass part side ground part 3*a* that is not overlapped with the metallic part 6, and the radiating element 2 that is not overlapped with the metallic part 6. According to this structure, the vehicle provided with the antenna having the desired characteristics can be obtained.

Second Preferred Embodiment

Figure 3B:
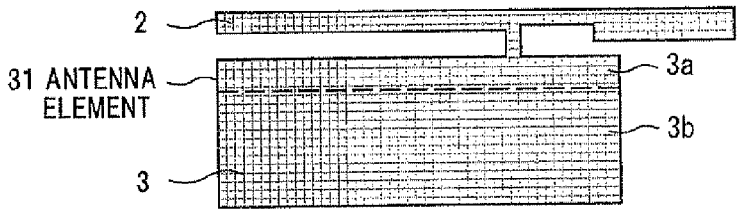

FIG. 3B is a plan view of an antenna element 31 of the glass antenna device 101 for a vehicle in the second preferred embodiment according to the invention.

In the antenna element 31 shown in FIG. 3B, the radiating element 2 and the ground part 3 are formed entirely in a lattice. Herein, the lattice is formed for example by combining a plurality of linear conductors (conductor lines) to be crossed with each other to provide a plurality of apertures. A thickness of the conductor line is preferably not greater than 100 μm, such that the field of view is not disturbed by the antenna element 31. In this preferred embodiment, the thickness of the conductor line is 80 μm, so that each of the conductor lines is hardly visible. A pith of the conductor line is for example 650 nm.

A pattern of the lattice shown in FIG. 3B is a grid pattern comprising vertical conductor lines provided in parallel with a short side of the ground part 3 and lateral conductor lines provided in parallel with a long side of the ground part 3. However, the present invention is not limited thereto. The lattice pattern may comprise two groups of conductor lines inclined by +45° and −45°, respectively, with respect to the long side of the ground part 3. The lattice pattern may comprise three groups of conductor lines crossed with each other at an angle of 120°. Further, the lattice pattern may be hound's-tooth check, honeycomb, porous, or the like.

Since the radiating element 2 and the ground part 3 are formed to have the lattice shape, a deterioration of the field of view can be further suppressed.

Third Preferred Embodiment

Figure 3C:
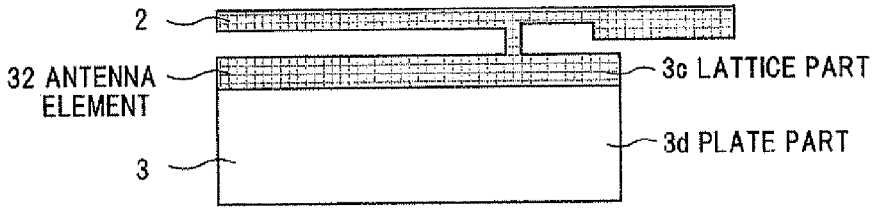

FIG. 3C is a plan view of an antenna element 32 of the glass antenna device 101 for a vehicle in the third preferred embodiment according to the invention.

In the antenna element 32 shown in FIG. 3B, the ground part 3 comprises a lattice part 3*c* formed in the lattice shape, and a plate part 3*d* formed to be a plane (so-called, "mat plane" or "solid plane") such as a conductive film. It is preferable that the lattice part 3*c* and the plate part 3*d* respectively correspond to the glass part side ground part 3*a* not to be overlapped with the metallic part 6 and the metallic part side ground part 3*b* to be overlapped with the metallic part 6 in FIG. 1.

In this antenna element 32, the lattice parts with a good optical transparency (the radiating element 2 and the lattice part 3*c*) and the plate part with a bad optical transparency (the plate part 3*d*) can be distinguished easily from each other by visual inspection. Therefore, when the antenna element 32 is installed at the vehicle 4, it is possible to install the antenna element 32 in a desired location by aligning (i.e. coinciding) a boundary between the lattice part 3*c* and the plate part 3*d* with an edge of the metallic part 6, such that the lattice part 3*c* is not overlapped with the metallic part 6 and the plate part 3*d* is overlapped with the metallic part 6. In other words, by using the antenna element 32 for the glass antenna device 101 for a vehicle, it is possible to provide an effect of facilitating the alignment of the glass antenna device 101 for a vehicle in addition to an effect of improving the visibility in the field of view and an effect of obtaining stable operating characteristics.

Fourth Preferred Embodiment

Figure 3D:
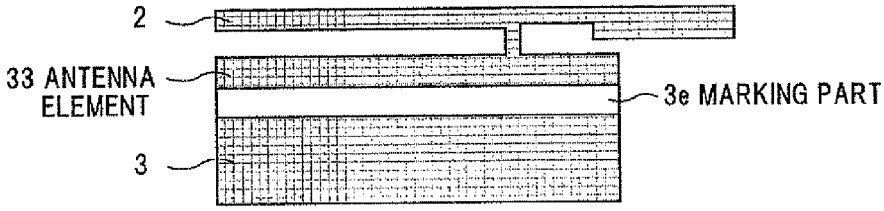

FIG. 3D is a plan view of an antenna element 33 of the glass antenna device 101 for a vehicle in the fourth preferred embodiment according to the invention.

The antenna element 33 shown in FIG. 3D is similar to the antenna element 31 shown in FIG. 3B, except that a marking part 3*e* is formed on the ground part 3, at a boundary between two parts corresponding to the glass part side ground part 3*a* not to be overlapped with the metallic part 6 and the metallic part side ground part 3*b* to be overlapped with the metallic part 6 shown in FIG. 1. The marking part 3*e* comprises a strip-shape conductor. According to this preferred embodiment, it is possible to obtain the effect of facilitating the alignment of the glass antenna device 101 for a vehicle, similarly to the third preferred embodiment using the antenna element 32 shown in FIG. 3C.

(Materials of the Glass Antenna Device 101 for a Vehicle)

Next, materials composing the glass antenna device 101 for a vehicle in the present invention will be explained.

In the glass antenna device 101 for a vehicle according to the present invention, the radiating element 2 and the ground part 3 of the antenna element 1 may comprise a printed circuit board. A thickness of the printed circuit board is not greater than 0.1 mm, in order to improve the transparency.

The printed circuit board preferably comprises a sheet-like transparent substrate, such as a glass epoxy substrate and the conductors. The conductors are printed on a transparent substrate for a printed circuit board to form the radiating element 2 and the ground part 3, to provide a so-called sheet-like antenna. The antenna element 1 comprising the sheet-like antenna may be fixed on the glass part 5 of the vehicle 4 by a fixing means such as a pressure sensitive adhesive double-sided tape.

In addition, the antenna element of the glass antenna device 101 for a vehicle may be formed by directly printing the conductors on a glass itself to be used as the glass part 5 such as the front glass 7 of the vehicle, in place of attaching or fixing the glass part side ground part 3*a* to the glass part 5. In more concrete, the conductors such as Ag paste is printed by screen printing directly on a glass material, prior to assembling of the glass part 5 such as the front glass 7 into the vehicle 4, and the glass material on which the conductors are printed is annealed to accomplish the glass part 5 with a curvature such as the front glass 7.

The antenna element of the glass antenna device 101 for a vehicle may be formed by punching a metal plate to provide the radiating element 2 and the ground part 3. For forming the lattice-shaped part of the antenna element, a plurality of the apertures in the lattice-shaped part may be formed by punching simultaneously with punching an outline (frame) of the radiating element 2 and ground part 3. The metal plate may comprise copper, phosphor bronze, copper alloy, stainless, or the like.

(Method for Fabricating the Antenna Element)

Next, a method for fabricating the antenna element of the glass antenna device 101 for a vehicle according to the present invention will be explained. In more concrete, a method for fabricating the antenna element (sheet-like antenna) 31 shown in FIG. 3B will be explained.

FIGS. 4A to 4E are plan views of an antenna element sheet for showing a method for fabricating the antenna element, and FIGS. 5A to 5E are enlarged cross sectional views of one antenna element for showing the method for fabricating the antenna element. For the explanatory purpose, the number of the conductors constituting the lattice part is reduced compared with the actual device in FIGS. 5A to 5D.

Figure 4A:
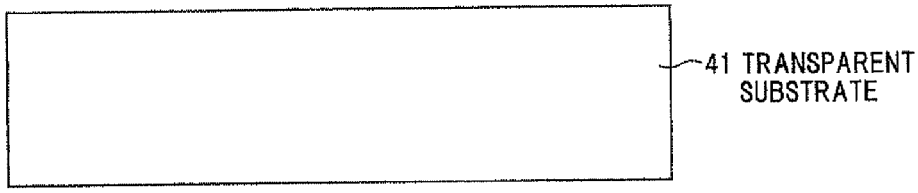
FIGS. 4A to 4E are plan views of an antenna element sheet for showing a method for fabricating the antenna element.
Figure 5A:
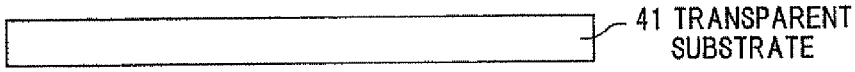
FIGS. 5A to 5E are enlarged cross sectional views of one antenna element for showing the method for fabricating the antenna element.

As shown in FIG. 4A and FIG. 5A, a lengthy and rectangular shaped transparent substrate 41 for a printed circuit board is prepared.

Figure 4B:
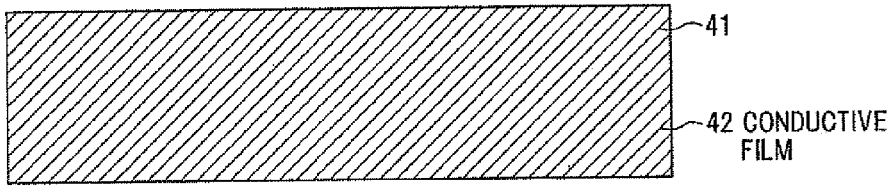
Figure 5B:
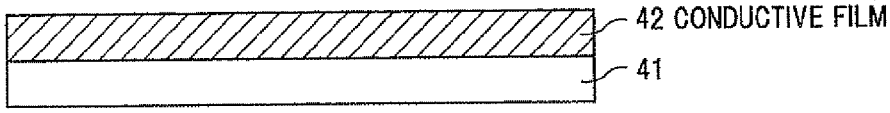

Then, as shown in FIG. 4B and FIG. 5B, a conductive film 42 is formed by copper plating or the like on an entire surface of the transparent substrate 41.

Figure 4C:
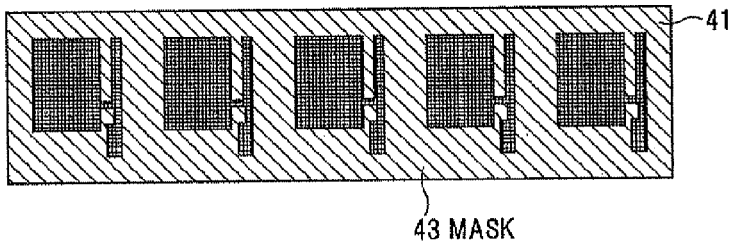
Figure 4D:
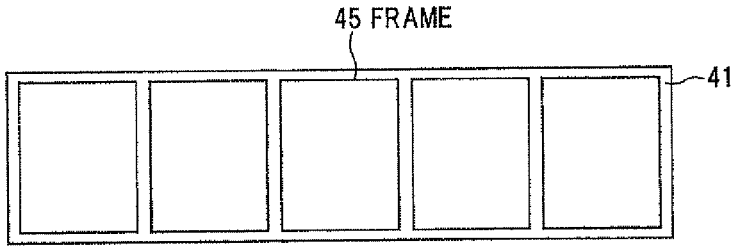
Figure 4E:
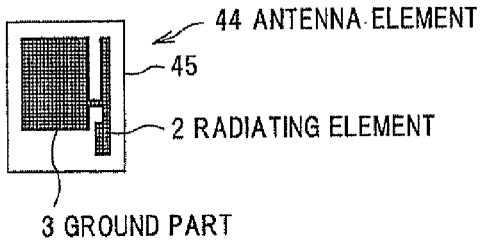
Figure 5C:
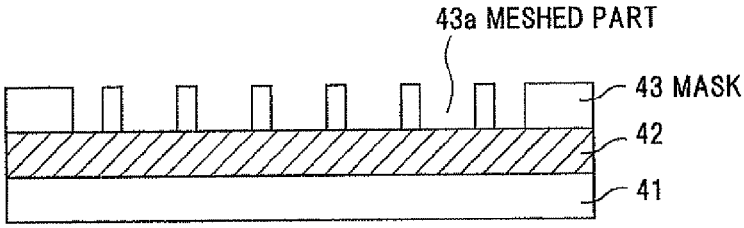
Figure 5D:
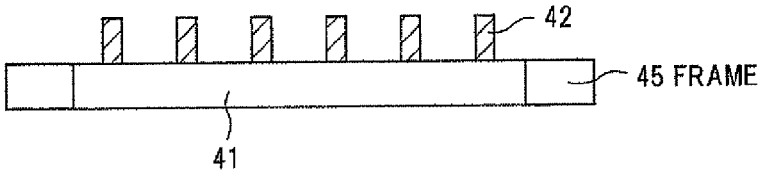
Figure 5E:
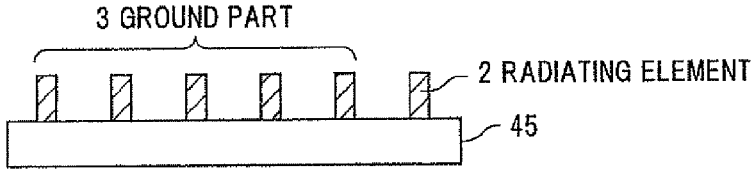

As shown in FIG. 4C and FIG. 5C, a mask 43 with meshed parts 43*a* for exposure is stuck on an entire surface of the conductive film 42. The mask 43 covers an entire outline of the antenna element, and the meshed part 43*a* is provided within the outline of the antenna element. After the exposure, the mask 43 is torn off and an unnecessary part of the conductive film 42 is removed by etching as shown in FIG. 5D.

In addition, the conductive film 42 may be provided thickly during the copper plating, and Ni plating may be further provided on the conductive film 42 by soaking into Ni plating solution for the purpose of corrosion resistance. In addition, Au plating may be provided by dipping into an Au plating solution for the purpose of stabilizing a soldering portion (to be described later).

As shown in FIG. 49, the transparent substrate 41 on which the antenna elements are formed (the printed circuit board) is punched along respective frames 45.

As a result, an antenna element 44 formed in the rectangular frame 45 is fabricated as shown in FIG. 4A. A plurality of the antenna elements 44 are fabricated by punching for one or more times.

In the antenna element 44 thus fabricated, the radiating element 2 and the ground part 3 are entirely formed in the lattice shape. The antenna element 44 thus fabricated is stuck at the boundary of the glass part 5 and the metallic part 6 of the vehicle 4.

According to the method for fabricating the antenna element of the glass antenna device for a vehicle of the present invention, the printed circuit board with a high productivity is used, and the antenna element 44 as the sheet-like antenna is formed by punching, thereby improving mass-productivity as well as controlling dispersion in size to improve a dimensional precision.

Sixth Preferred Embodiment

Figure 6:
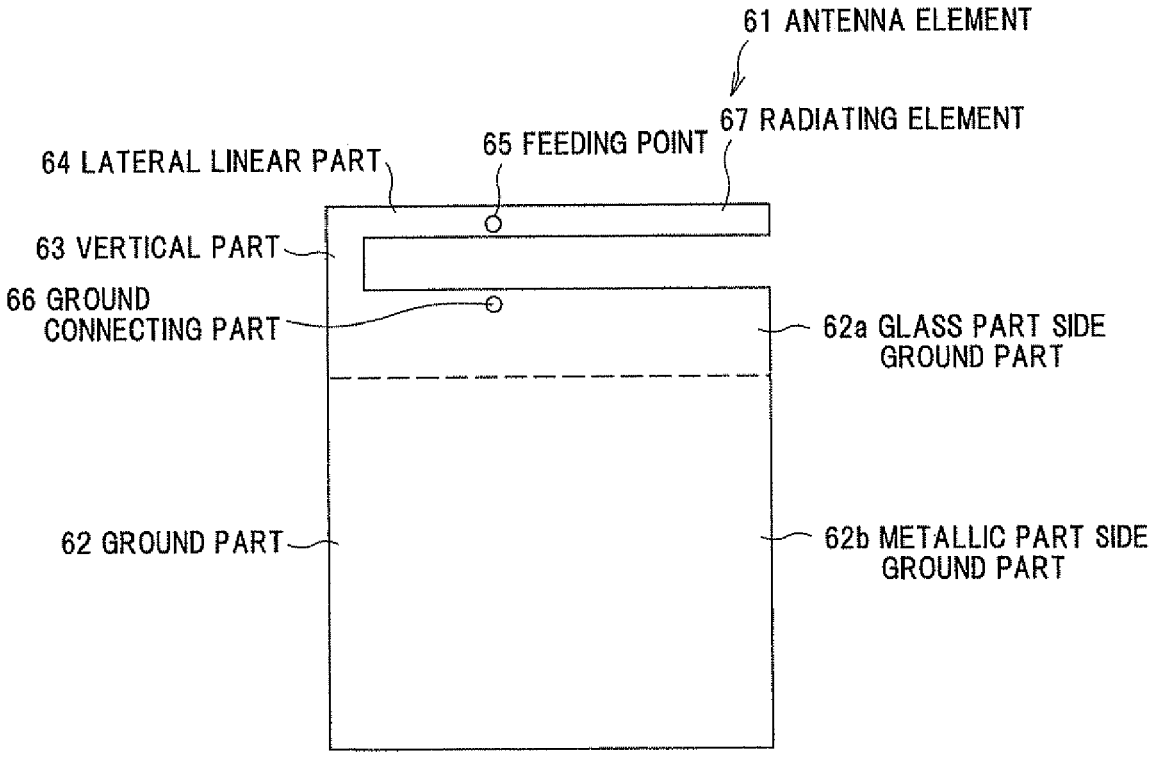
FIG. 6 is a plan view of an antenna element of a glass antenna device for a vehicle in a fifth preferred embodiment according to the present invention.

FIG. 6 is a plan view of an antenna element of a glass antenna device for a vehicle in a six preferred embodiment according to the present invention.

As shown in FIG. 6, an antenna element 61 comprises a rectangular or square ground part 62 provided with two adjacent sides having almost equal lengths, a vertical part 63 extending vertically from one end of the ground part 62, a lateral linear part 64 extending from the vertical part 63 in parallel with the ground part 62, a feeding point 65 provided at a predetermined position of the lateral linear part 64, and a ground connecting part 66 provided at a position facing to the feeding point 65 of the ground part 62. A tip portion with respect to the feeding point 65 of the lateral linear part 64 is a radiating element 67. The ground part 62 comprises a glass part side ground part 62*a* and a metallic part side ground part 62*b* as shown by a broken line.

In the antenna element 61 according to the sixth preferred embodiment, the effect of the present invention can be obtained, if the antenna element 61 is installed in the vehicle, such that the metallic part side ground part 62*b* of the ground part 62 is overlapped with the metallic part 6 of the vehicle 4, and the radiating element 67 and the glass part side ground part 62*a* of the ground part 62 facing to the radiating element 67 are not overlapped with the metallic part 6.

Seventh Preferred Embodiment

Figure 7:
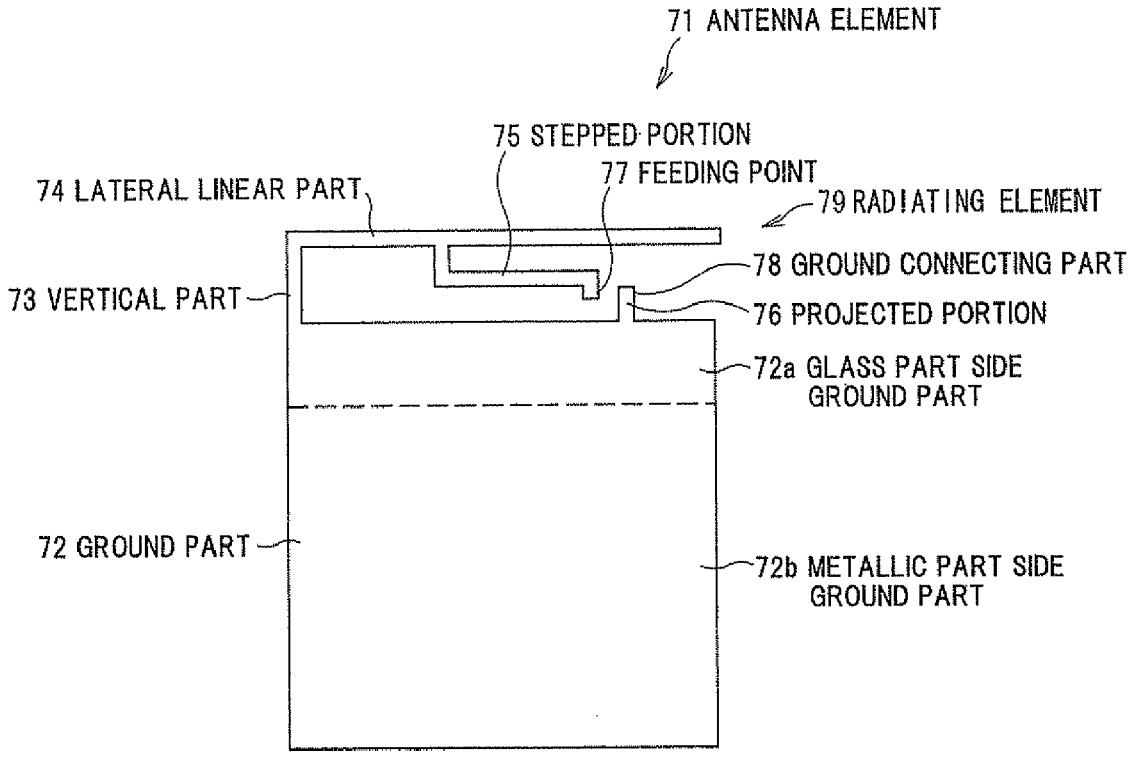
FIG. 7 is a plan view of an antenna element of a glass antenna device for a vehicle in a sixth preferred embodiment according to the present invention.

FIG. 7 is a plan view of an antenna element of a glass antenna device for a vehicle in a seventh preferred embodiment according to the present invention.

As shown in FIG. 7, an antenna element 71 comprises a rectangular or square ground part 72 provided with two adjacent sides having almost equal lengths, a vertical part 73 extending vertically from one end of the ground part 72, a lateral linear part 74 extending from the vertical part 73 in parallel with the ground part 72, a stepped (L-shaped) portion 75 projected from a predetermined position of the lateral linear part 74, a projected portion 76 protruded from the ground part 72 to a point facing to the stepped portion 75, a feeding point 77 provided at the stepped portion 75, and a ground connecting part 78 provided at the projected portion 76. A tip portion with respect to the feeding point 77 of the lateral linear part 74 is a radiating element 79. The ground part 72 comprises a glass part side ground part 72*a* and a metallic part side ground part 72*b* as shown by a broken line.

In the antenna element 71 according to the seventh preferred embodiment, the effect of the present invention can be obtained, if the antenna element 71 is installed in the vehicle, such that the metallic part side ground part 72*b* of the ground part 72 is overlapped with the metallic part 6 of the vehicle 4, and the radiating element 79 and the glass part side ground part 72*a* of the ground part 72 facing to the radiating element 79 are not overlapped with the metallic part 6.

A configuration of the antenna element to be used in the glass antenna device for a vehicle according to the present invention is not limited to the configurations shown in FIG. 1 to FIG. 7. The configuration of the antenna element may be determined appropriately in accordance with the intended use and the characteristics such as antenna characteristics, operating characteristics.

Eighth Preferred Embodiment

Figure 8:
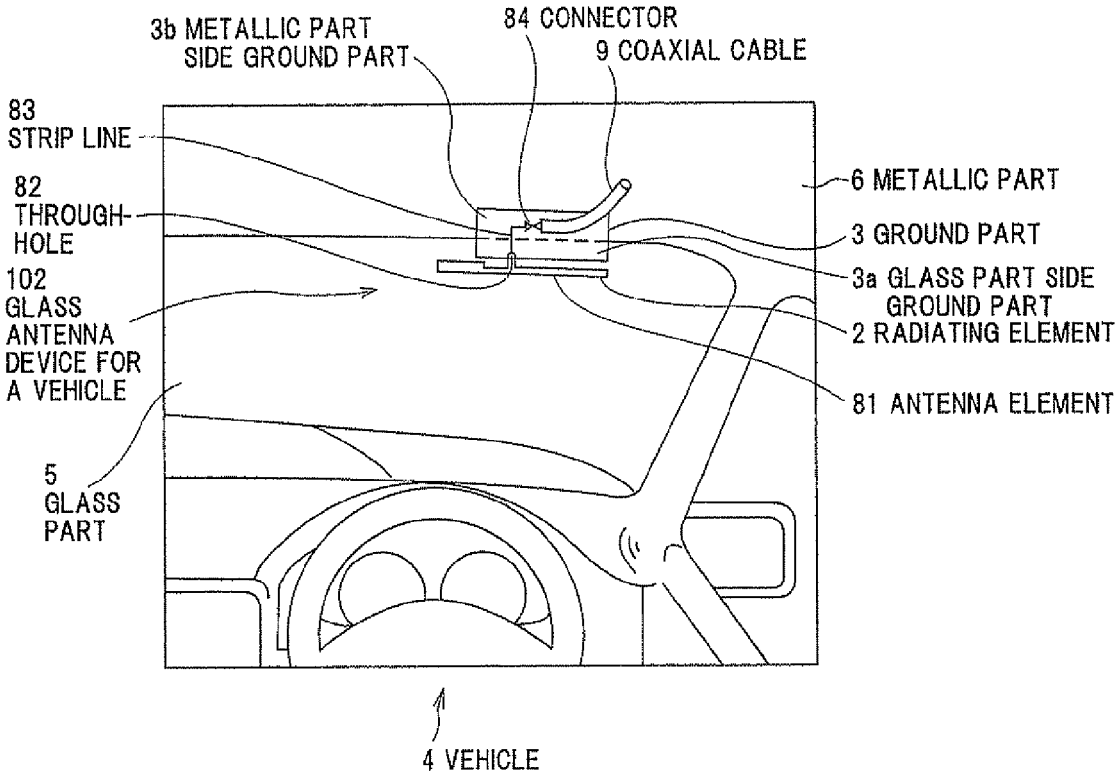
FIG. 8 is a schematic diagram of a glass antenna device for a vehicle that is installed in the vehicle in a seventh preferred embodiment according to the present invention.

FIG. 8 is a schematic diagram of a glass antenna device for a vehicle that is installed in the vehicle in an eighth preferred embodiment according to the present invention.

As shown in FIG. 8, a glass antenna device 102 for a vehicle in the eighth preferred embodiment according to the invention comprises an antenna element 81 that is installed in a glass part 5 of a vehicle 4. The antennal element 81 comprises a ground part 3 and a radiating element 2. A metallic part side ground part 3*b* of the ground part 3 is overlapped with a metallic part 6 of the vehicle 4, while a glass part side ground part 3*a* of the ground part 3 and the radiating element 2 are not overlapped with the metallic part 6.

The glass antenna device 102 for a vehicle shown in FIG. 8 is similar to the glass antenna device 101 for a vehicle shown in FIG. 1 in the configuration and location of the radiating element 2 and the ground part 3. On the other hand, the glass antenna device 102 for a vehicle shown in FIG. 8 is different from the glass antenna device 101 for a vehicle shown in FIG. 1 in a connecting status of a coaxial cable 9.

The antenna element 81 comprises a multilayer printed circuit board. The radiating element 2 is connected to a feeding point at a surface of the multilayer printed circuit board, the feeding point is connected to a through-hole 82, and the through-hole 82 is connected to a strip line 83 provided at an inner layer of the multilayer printed circuit board. A connector 84 is connected to the strip line 83, and an inner conductor of the coaxial cable 9 is connected to the connector 84.

According to this preferred embodiment, it is possible to realize the glass antenna device for a vehicle having the stable operating characteristics similar to those in the first preferred embodiment.

Ninth Preferred Embodiment

Figure 9:
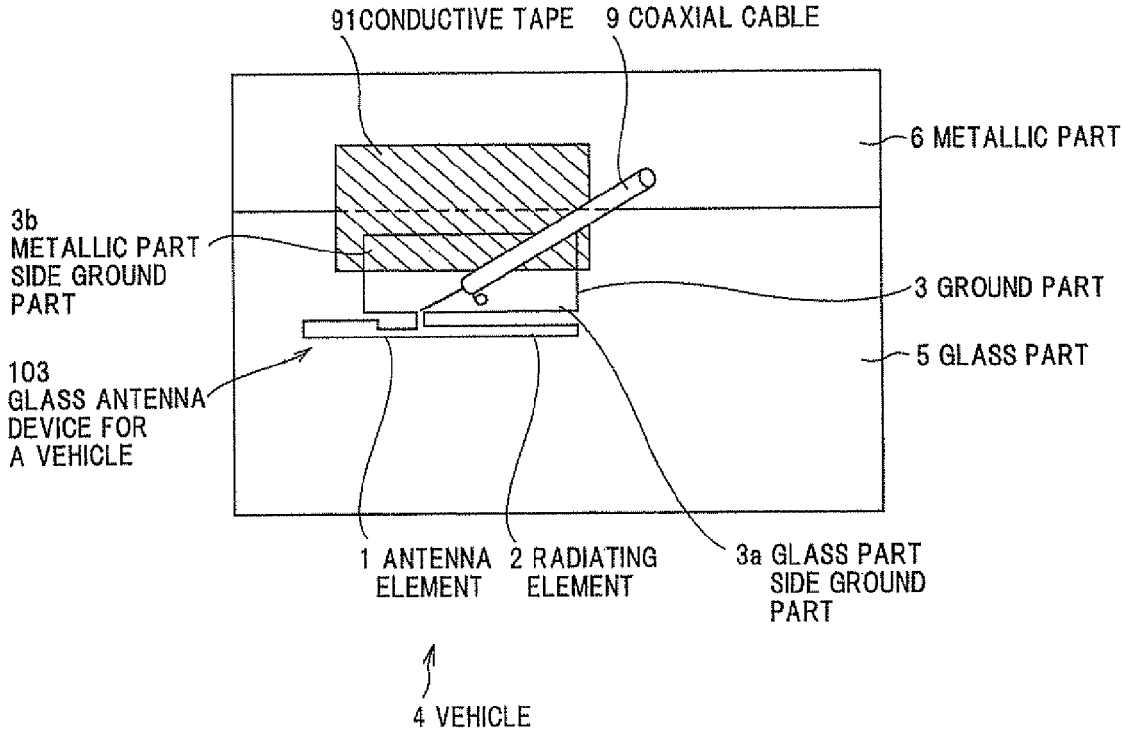
FIG. 9 is a schematic diagram of a glass antenna device for a vehicle that is installed in the vehicle in an eighth preferred embodiment according to the present invention.

FIG. 9 is a schematic diagram of a glass antenna device for a vehicle that is installed in the vehicle in a ninth preferred embodiment according to the present invention.

The glass antenna device 103 for a vehicle shown in FIG. 9 is similar to the glass antenna device 101 for a vehicle shown in FIG. 1 except that the ground part 3 of the antenna element 1 and the metallic part 6 of the vehicle 4 are connected each other by means of a conductive tape 91.

In the glass antenna device 103 for a vehicle, the antenna element 1 is provided at the glass part 5 of the vehicle 4, a part of the conductive tape 91 is overlapped with the metallic part side ground part 3*b* of the ground part 3, and a remaining part of the conductive tape 91 is overlapped with the metallic part 6 of the vehicle. The conductive tape 91 may comprises a copper tape or the like.

According to this preferred embodiment, it is possible to realize the glass antenna device for a vehicle having the stable operating characteristics similar to those in the first preferred embodiment.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A glass antenna device for a vehicle, comprising:

an antenna element to be installed at a glass part, the antenna element comprising:

a rectangular ground part including a first part and a second part; and a radiating element comprising one side being in parallel with one side of the ground part, the radiating element being distant from the one side of the ground part by a predetermined spacing;

wherein the first part of the ground part is configured to be overlapped with a conductive member;

wherein the second part of the ground part includes the one side of the ground part and faces the radiating element, wherein the second part of the ground part is configured not to be overlapped with the conductive member, a longitudinal side of the radiating element being in parallel with a boundary between the first part and the second part, the longitudinal side of the radiating element extending the length of the radiating element, wherein the ground part has a rectangular shape, and the radiating element comprises a first part extending vertically from one side of the ground part and a second part extending from the first part in parallel with the one side of the ground part, wherein the second part of the radiating element comprises two resonant parts having resonant frequencies different from each other, wherein at least one of the two resonant parts comprises a narrow width part and a wide width part in a longitudinal direction, and wherein the wide width part extends beyond one end of the ground part.

2. The glass antenna device for a vehicle, according to claim 1, wherein the conductive member is a metallic part of the vehicle.

3. The glass antenna device for a vehicle, according to claim 1, wherein the conductive member is a conductive tape overlapped with a metallic part of the vehicle.

4. The glass antenna device for a vehicle, according to claim 1, wherein the antenna element comprises linear conductors formed in a lattice shape.

5. The glass antenna device for a vehicle, according to claim 1, wherein the first part of the ground part comprises a plate-like conductor.

6. The glass antenna device for a vehicle, according to claim 1, wherein the ground part further comprises a marking part on the ground part at a boundary of the first part and the second part.

7. The glass antenna device for a vehicle, according to claim 1, wherein the conductive member is a roof frame of the vehicle.

8. The glass antenna device for a vehicle, according to claim 1, wherein the glass part is a front glass of the vehicle.

9. The glass antenna device for a vehicle, according to claim 1, wherein the antenna element comprises a transparent sheet and a conductor printed on the transparent sheet.

10. The glass antenna device for a vehicle, according to claim 1, wherein the antenna element comprises a punched metal plate.

11. The glass antenna device for a vehicle, according to claim 1, wherein the first part of the ground part is attached to the conductive member, and the second part of the ground part and the radiating element are attached to the glass part.

12. The glass antenna device for a vehicle, according to claim 1, wherein the antenna element comprises a glass member to be assembled as the glass part in the vehicle, and a conductor printed and annealed on the glass member.

13. The glass antenna device for a vehicle, according to claim 1, wherein a ratio of an area of the second part to an area of the first part is within a range of 1:5 to 1:10.

14. A vehicle provided with a glass antenna device, comprising:

a glass part;

a metallic part; and an antenna element installed at a glass part, the antenna element comprising:

a rectangular ground part including a first part, and a second part; and a radiating element comprising one side being in parallel with one side of the ground part, the radiating element being distant from the one side of the ground part by a predetermined spacing, wherein the first part of the ground part is configured to be overlapped with a conductive member, wherein the second part of the ground part includes the one side of the ground part and faces the radiating element, wherein the second part of the ground part is configured to be not overlapped with the metallic part, a longitudinal side of the radiating element being in parallel with a boundary between the first part and the second part, the longitudinal side of the radiating element extending the length of the radiating element, wherein the ground part has a rectangular shape, and the radiating element comprises a first part extending vertically from one side of the ground part and a second part extending from the first part in parallel with the one side of the ground part, wherein the second part of the radiating element comprises two resonant parts having resonant frequencies different from each other, wherein at least one of the two resonant parts comprises a narrow width part and a wide width part in a longitudinal direction, and wherein the wide width part extends beyond one end of the ground part.

* * * * *